US011248598B2

(12) United States Patent
Vala et al.

(10) Patent No.: US 11,248,598 B2
(45) Date of Patent: Feb. 15, 2022

(54) OPTIMAL EFFICIENCY OPERATION IN PARALLEL PUMPING SYSTEM WITH MACHINE LEARNING

(71) Applicant: Fluid Handling LLC, Morton Grove, IL (US)

(72) Inventors: Gaurav B. Vala, Des Plaines, IL (US); James J. Gu, Buffalo Grove, IL (US)

(73) Assignee: FLUID HANDLING LLC, Morton Grove, IL (US)

( * ) Notice: Subject to any disclaimer, the term of this patent is extended or adjusted under 35 U.S.C. 154(b) by 68 days.

(21) Appl. No.: 16/436,314

(22) Filed: Jun. 10, 2019

(65) Prior Publication Data

US 2019/0376507 A1 Dec. 12, 2019

Related U.S. Application Data

(60) Provisional application No. 62/682,429, filed on Jun. 8, 2018.

(51) Int. Cl.
*F04B 49/06* (2006.01)
*F04B 23/04* (2006.01)

(52) U.S. Cl.
CPC ..... *F04B 49/065* (2013.01); *F04B 23/04* (2013.01)

(58) Field of Classification Search
CPC ..... G05B 19/47; F04B 49/065; F04B 23/04
See application file for complete search history.

(56) References Cited

U.S. PATENT DOCUMENTS 4,178,132 A 12/1979 Shiraishi et al.
4,805,118 A 2/1989 Rishel
(Continued)

FOREIGN PATENT DOCUMENTS

WO 2009020402 A1 2/2009
WO 2016153895 A1 9/2016
(Continued)

OTHER PUBLICATIONS

Cherchi, Carla, et al. "Energy and water quality management systems for water utility's operations: A review." Journal of environmental management 153 (2015): 108-120. https://behpouyan.ir/uploads/maghalat/861-57f357e5-15f8-4ca8-b267-073db9041dc8.PDF.

(Continued)

*Primary Examiner* — Kenneth J Hansen
(74) *Attorney, Agent, or Firm* — Ware, Fressola, Maguire & Barber LLP

(57) ABSTRACT

Apparatus features a controller having a signal processor or processing module configured to: receive signaling containing information about a power profile that is specific to a pumping system having N parallel pumps and based upon data related to one or more of pumping system power, losses and wire-to-water efficiency in real time for the N parallel pumps configured to run in the pumping system to generate a head H and a flow F with an efficiency E, and at least one calculation/prediction of at least one corresponding efficiency of at least one combination/number of N−1 and/or N+1 parallel pumps to achieve a corresponding/same head H and flow F with a corresponding efficiency; and determine corresponding signaling containing information to control the operation of the pumping system that depends on a comparison of the efficiency E and the at least one corresponding efficiency, based upon the signaling received, including staging/destaging a pump to or from the pumping system.

14 Claims, 5 Drawing Sheets

(56) References Cited

U.S. PATENT DOCUMENTS

| | | | | |
|---|---|---|---|---|
| 6,041,856 | A | 3/2000 | Thrasher et al. | |
| 6,330,525 | B1 | 12/2001 | Hays et al. | |
| 7,143,016 | B1 | 11/2006 | Discenzo et al. | |
| 8,036,872 | B2 | 10/2011 | Nasle | |
| 8,594,851 | B1 | 11/2013 | Smaidris | |
| 9,022,140 | B2 | 5/2015 | Marx et al. | |
| 9,181,953 | B2 | 11/2015 | Steger et al. | |
| 9,488,388 | B1 | 11/2016 | Siegenthaler | |
| 9,647,591 | B2 | 5/2017 | West et al. | |
| 9,938,805 | B2 | 4/2018 | Suprick et al. | |
| 2004/0064292 | A1 | 4/2004 | Beck et al. | |
| 2007/0150113 | A1* | 6/2007 | Wang | G05D 7/0641 700/282 |
| 2007/0175633 | A1 | 8/2007 | Kosmala et al. | |
| 2010/0312400 | A1 | 12/2010 | Steffensen | |
| 2014/0180485 | A1 | 6/2014 | Stavale | |
| 2014/0277754 | A1 | 9/2014 | Miller | |
| 2015/0095100 | A1 | 4/2015 | Vittal et al. | |
| 2016/0265341 | A1 | 9/2016 | Subervie et al. | |
| 2017/0051737 | A1 | 2/2017 | Ellsworth | |
| 2017/0268517 | A1 | 9/2017 | Mangutov et al. | |
| 2017/0359418 | A1 | 12/2017 | Sustaeta et al. | |

FOREIGN PATENT DOCUMENTS

| | | | |
|---|---|---|---|
| WO | 2017143410 | A1 | 8/2017 |
| WO | 2017161126 | A1 | 9/2017 |
| WO | 2018035718 | A1 | 3/2018 |

OTHER PUBLICATIONS

Katiyar, Vineet. "Production well operations optimization in water distribution system using genetic algorithm." (2007). https://digitalcommons.lsu.edu/cgi/viewcontent.cgi?article=4224&context=gradschool_theses.

Bagloee, Saeed Asadi, Mohsen Asadi, and Michael Patnksson. "Minimization of water pumps' electncity usage: A hybrid approach of regression models with optimization." Expert Systems with Applications 107 (2018): 222-242. https://www.researchgate.net/profile/Saeed_Bagloee/publication/324706542_Minimization_of_water_pumps%27_electricity_usage_A_hybrid_approach_of_regression_models_with_optimization/links/5afd31ae0f7e9b98e03ea864/Minimization-of-water-pumps-electricity-usage-A-hybrid-approach-of-regression-models-with-optimization.pdf.

"Predictive Analytics for Pumps, Valves and Seals." Flowserve®, flowserve.com, 2017. https://www.flowserve.com/sites/default/files/2017-08/ps-90-11-e_0.pdf.

"Wire-to-Water Efficiency." Systecon®, Inc., systecon.com, accessed, Jun. 2018. https://www.systecon.com/media/documents/Wire-to-Water.pdf.

* cited by examiner

Apparatus 10, including a pump system,

A controller for a pumping system having a signal processor or signal processing module10a configured at least to:

receive signaling containing information about a power profile that is specific to a pumping system having N parallel pumps and that includes data related to pumping system power, losses and wire-to-water efficiency in real time for the N parallel pumps configured to run in the pumping system to generate a head H and a flow F with an efficiency E, and at least one calculation/prediction of at least one corresponding efficiency of at least one combination/number of N-1 and/or N+1 parallel pumps to achieve a corresponding/same head H and flow F; and determine corresponding signaling containing information to control the operation of the pumping system that depends on a comparison of the efficiency E and the at least one corresponding efficiency, based upon the signaling received.

Other signal processor circuits, circuitry, or components 10b that do not form part of the underlying invention, e.g., including input/output modules/modems, one or more memory modules (e.g., RAM, ROM, etc.), data, address and control busing architecture, etc.

Figure 1

Control curve

50

OPTIMAL EFFICIENCY OPERATION IN PARALLEL PUMPING SYSTEM WITH MACHINE LEARNING

CROSS-REFERENCE TO RELATED APPLICATION

This application claims benefit to provisional patent application Ser. No. 62/682,429, filed 8 Jun. 2018, which is hereby incorporated by reference in its entirety.

BACKGROUND OF THE INVENTION

1. Field of the Invention

The present invention relates to a pumping system; and more particularly relates to a pumping system having a controller.

2. Brief Description of Related Art

Pump control algorithms to achieve optimal system efficiency is of high interest. Current pumping system uses the pressure and flow based methods to control a number of variable speed parallel pumps running in a system to achieve the required demand. This does not ensure the optimal efficiency of operation of an individual pump and hence the pumping system.

Pumping system losses will vary based on losses in the motor and variable frequency drive. The make of motors and VFDs vary for different pumping systems, so all pumping systems are unique and have different losses.

SUMMARY OF THE INVENTION

In summary, the present invention calculates the efficiency in real-time for numbers of centrifugal parallel pumps running in a pumping system and calculates/predicts new combinations/numbers of pumps to run for optimal efficiency.

According to the present invention, a controller may be configured to implement a machine learning algorithm that keeps logging the pumping system power, losses and wire-to-water efficiency in real-time and stores in an internal database of the controller to create a power profile specific to the pumping system. The machine learning algorithm may also be configured to keep updating the power profile considering the pump/motor wear and tear over time. The same power profile may be used to calculate/predict a new efficiency for different combinations of pumps in the pumping system.

In operation, the controller calculates the pumping system's current wire-to-water efficiency and compares it with a calculated/predicted efficiency when running different combinations of pumps. For example, if N number of pumps are running in a pumping system that generates H head and Q flow with an efficiency E1, then the machine learning algorithm calculates/predicts a new efficiency using a power profile if running N−1 and N+1 pumps in the pumping system to achieve the same H head and Q flow. If the calculated/predicted efficiency for running N−1 pumps is higher than the efficiency E1, then this machine learning algorithm stops one pump in the pumping system. Alternatively, if the calculated/predicted efficiency for N+1 pump is higher than the efficiency E1, then this machine learning algorithm starts one pump in the pumping system. The machine learning algorithm updates the power profile and monitoring system to conclude the number of pumps required to operate the pumping system close to an optimal point on an efficiency curve.

Specific Embodiments

According to some embodiments, the present invention may take the form of a apparatus featuring a controller having a signal processor or processing module configured to:

- receive signaling containing information about
  - a power profile that is specific to a pumping system having N parallel pumps and based upon data related to one or more of pumping system power, losses and wire-to-water efficiency in real time for the N parallel pumps configured to run in the pumping system to generate a head H and a flow F with an efficiency E, and
  - at least one calculation/prediction of at least one corresponding efficiency of at least one combination/number of N−1 and/or N+1 parallel pumps to achieve a corresponding/same head H and flow F; and
- determine corresponding signaling containing information to control the operation of the pumping system that depends on a comparison of the efficiency E and the at least one corresponding efficiency, based upon the signaling received.

The apparatus may also include one or more of the following features:

The signal processor or processing module may be configured to provide the corresponding signaling as control signaling to control the operation of the pumping system, e.g., including staging/destaging a pump to or from the pumping system.

The signal processor or processing module may be configured to determine the power profile that is specific to the pumping system having the N parallel pumps and based upon data related to the one or more of pumping system power, losses and wire-to-water efficiency in real time for the N parallel pumps configured to run in the pumping system to generate the head H and the flow F with the efficiency E.

The signal processor or processing module may be configured to:

- calculate/predict corresponding efficiencies for the N−1 and N+1 parallel pumps to achieve the corresponding/same head H and flow F; and
- determine the corresponding signaling by selecting a highest efficiency between the efficiency E for the N parallel pumps and the corresponding efficiencies for the N−1 and N+1 parallel pumps.

The signal processor or processing module may be configured to stop or start a parallel pump from running in the pumping system when changing from the N parallel pumps to the N−1 or N+1 parallel pumps running in the pumping system.

The signal processor or processing module may be configured to implement a machine learning algorithm to update the power profile and monitoring system to conclude the combination/number of the N parallel pumps required to operate the pumping system close to an optimal point on an efficiency curve.

The controller may include an internal database configured to store an updated power profile, including the data related to the one or more of the pumping system power, losses and wire-to-water efficiency.

The apparatus may include, or take the form of, the pumping system having the N parallel pumps.

The signal processor or processing module may be configured to run the machine learning algorithm to implement the aforementioned signal processing functionality.

The Method

According to some embodiments, the present invention may include, or take the form of, a method featuring steps for:

receiving, with a controller having a signal processor or processing module, signaling containing information about a power profile that is specific to a pumping system having N parallel pumps and based upon data related to one or more of pumping system power, losses and wire-to-water efficiency in real time for the N parallel pumps configured to run in the pumping system to generate a head H and a flow F with an efficiency E, and at least one calculation/prediction of at least one corresponding efficiency of at least one combination/number of N−1 and/or N+1 parallel pumps to achieve a corresponding/same head H and flow F; and determining, with the controller having the signal processor or processing module, corresponding signaling containing information to control the operation of the pumping system that depends on a comparison of the efficiency E and the at least one corresponding efficiency, based upon the signaling received.

The method may also include one or more of the features set forth herein.

BRIEF DESCRIPTION OF THE DRAWING

The drawing, which is not necessarily drawn to scale, includes the following Figures:

FIG. 1 is a block diagram of apparatus, e.g., including a pumping system, according to some embodiments of the present invention.

Similar parts or components in Figures are labeled with similar reference numerals and labels for consistency. Every lead line and associated reference label for every element is not included in every Figure of the drawing to reduce clutter in the drawing as a whole.

DETAILED DESCRIPTION OF THE INVENTION

FIG. 1

Figure 2:
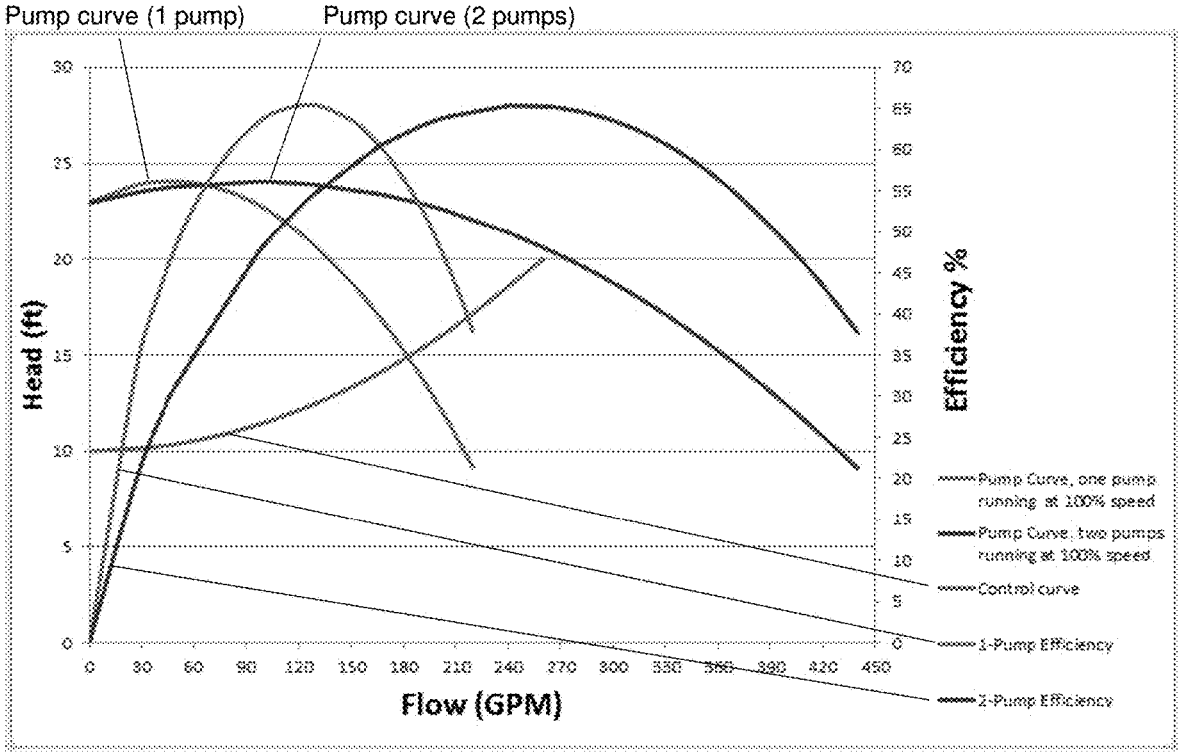
FIG. 2 is a graph of performance curves of Flow vs. Head (ft), and Flow (GPM) vs. Efficiency (%), including a pump curve for one pump running at 100% speed, a pump curve for two pumps running at 100% speed, a control curve, 1-pump efficiency curve and 2-pump efficiency curve, for comparing efficiencies and speed based staging/destaging of pumps in a pumping system using the efficiency method, according to some embodiments of the present invention.

According to some embodiments, the present invention may include, or take the form of, apparatus 10 featuring a controller having a signal processor or processing module 10*a* configured to:

receive signaling containing information about a power profile that is specific to a pumping system having N parallel pumps and based upon data related to one or more of pumping system power, losses and wire-to-water efficiency in real time for the N parallel pumps configured to run in the pumping system to generate a head H and a flow F with an efficiency E, and at least one calculation/prediction of at least one corresponding efficiency of at least one combination/number of N−1 and/or N+1 parallel pumps to achieve a corresponding/same head H and flow F; and determine corresponding signaling containing information to control the operation of the pumping system that depends on a comparison of the efficiency E and the at least one corresponding efficiency, based upon the signaling received.

The signal processor or processing module 10*a* may be configured to provide the corresponding signaling as control signaling to control the operation of the pumping system, e.g., including staging/destaging a pump to or from the pumping system.

The signal processor or processing module 10*a* may also be configured to determine the power profile that is specific to a pumping system having N parallel pumps and that includes data related to the one or more of pumping system power, losses and wire-to-water efficiency in real time for the N parallel pumps configured to run in the pumping system to generate the head H and the flow F with the efficiency E, e.g., including storing the power profile determined in a suitable database with a suitable time stamp.

The signal processor or processing module 10*a* may also be configured to:

calculate/predict corresponding efficiencies for the N−1 and N+1 parallel pumps to achieve the corresponding/same head H and flow F; and determine the corresponding signaling by selecting a highest efficiency between the efficiency E for the N parallel pumps and the corresponding efficiencies for the N−1 and N+1 parallel pumps.

The signal processor or processing module 10*a* may be configured to stop or start a parallel pump from running in the pumping system when changing from the N parallel pumps to the N−1 or N+1 parallel pumps running in the pumping system.

The signal processor or processing module 10*a* may be configured to implement a machine learning algorithm to update the power profile and monitoring system to conclude the combination/number of the N parallel pumps required to operate the pumping system close to an optimal point on an efficiency curve.

The controller may include an internal database configured to store an updated power profile, including the data related to one or more of the pumping system power, losses and wire-to-water efficiency.

The apparatus may include, or take the form of, the pumping system having the N parallel pumps.

Comparing Efficiency and Speed Based Staging/De-Staging

By way of example, FIG. 2 is a graph that shows performance curves of pumping systems having one pump running and two pumps running in a pumping system. By way of example, the pumping system is designed to achieve 270 GPM and 20 feet of head when both pumps runs at 100% speed. FIG. 2 includes a control curve for the system head varying from 10 feet to 20 feet. FIG. 2 also includes curves for one pump and two pump efficiencies respectively on the secondary Y-Axis.

Figure 3:
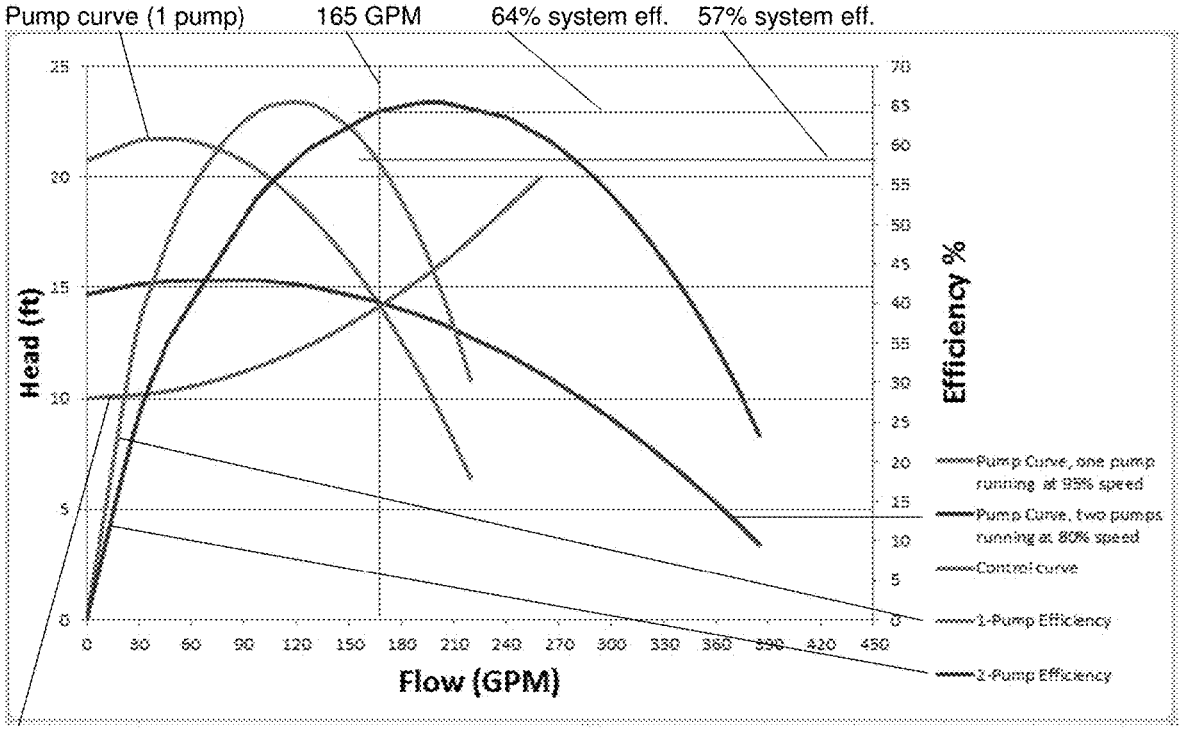
FIG. 3 is a graph of performance curves of Flow (GPM) vs. Head (ft), and Flow (GPM) vs. Efficiency (%), including a pump curve for one pump running at 95% speed, a pump curve for two pumps running at 80% speed, a control curve, 1-pump efficiency curve and 2-pump efficiency curve, for comparing efficiencies and speed based staging/destaging of pumps in a pumping system using the efficiency method, according to some embodiments of the present invention.

FIG. 3 and Table 1: Optimal Efficiency Staging

By way of further example, FIG. 3 and Table 1 shows a comparison of a one pump system and a two pump system in order to determine an optimal efficiency staging.

For example, Table 2 shows the one pump system for the one pump running at 95% speed, the head is about 14 feet, the system flow is 165 GPM, the system power is 1.03 HP, a system efficiency of 57%; and also shows the two pump system for the two pumps running at 80% speed, the head is about 14 feet, the system flow is 165 GPM, the system power is 0.94 HP, and a system efficiency of 64%, in order to compare the efficiency to achieve same H head and Q flow by running two pumps.

TABLE 1

| Number of Pumps | System Speed (%) | System Head (Ft) | System Flow (GPM) | System Power (HP) | System Eff (%) | Stage/ de-stage control method |
|---|---|---|---|---|---|---|
| 1 | 95 | 14 | 165 | 1.03 | 57 | Speed method |
| 2 | 80 | 14 | 165 | 0.94 | 64 | Efficiency method |

See and compare the curves shown in FIG. 3, including the pump curve for one pump running at 95% speed, the pump curve for the two pumps running at 80% speed, the control curve, the 1-pump efficiency curve and the 2-pump efficiency curve.

The data comparisions in Table 1 and the curve comparisons in FIG. 3 clearly shows that running two pumps in the pumping system to achieve a flow of 165 GPM and at 14 feet of H head is more efficient then running one pump in the pumping system.

Figure 4:
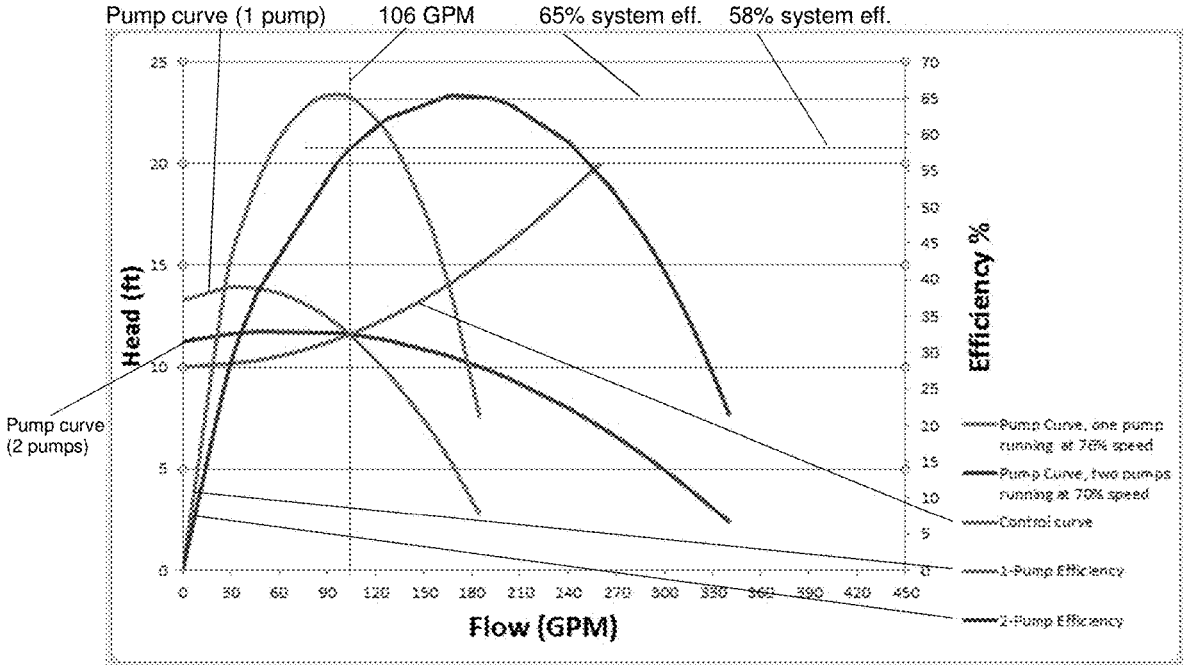
FIG. 4 is a graph of performance curves of Flow (GPM) vs. Head (ft), and Flow (GPM) vs. Efficiency (%), including a pump curve for one pump running at 76% speed, a pump curve for two pumps running at 70% speed, a control curve, 1-pump efficiency curve and 2-pump efficiency curve, for comparing efficiencies and speed based staging/destaging of pumps in a pumping system using the efficiency method, according to some embodiments of the present invention.

FIG. 4 and Table 2: Optimal Efficiency De-Staging

By way of still further example, FIG. 4 and Table 2 shows a comparison of a one pump system and a two pump system.

For example, Table 2 shows the one pump system for the one pump running at 76% speed, the head is about 11 feet, the system flow is 106 GPM, the system power is 0.47 HP, a system efficiency of 65%; and also shows the two pump system for the two pumps running at 70% speed, the head is about 11 feet, the system flow is 106 GPM, the system power is 0.53 HP, and a system efficiency of 58%, in order to compare the efficiency to achieve same H head and Q flow by running two pumps.

TABLE 2

| Number of Pumps | System Speed (%) | System Head (Ft) | System Flow (GPM) | System Power (HP) | System Eff (%) | control method |
|---|---|---|---|---|---|---|
| 1 | 76 | 11 | 106 | 0.47 | 65 | Speed method |
| 2 | 70 | 11 | 106 | 0.53 | 58 | Efficiency method |

See and compare the curves shown in FIG. 4, including the pump curve for one pump running at 76% speed, the pump curve for the two pumps running at 70% speed, the control curve, the 1-pump efficiency curve and the 2-pump efficiency curve.

The data comparisions in Table 2 and the curve comparisons in FIG. 4 clearly shows that running one pump in the pumping system to achieve a flow of 106 GPM and at 11 feet of H head is more efficient then running two pumps in the pumping system.

Control Features

According to the present invention, the following one or more of control features may be implemented, as follows:

1. Avoid Demand Spike

The control technology set forth herein keeps track of demand by logging the demand over the period of time and generates the demand curve, with the generated demand curve and historical data peak demand time can be predicted and necessary action can be taken to avoid demand spike.

2. User Adjustable Control Variable

The user can:

Enable or disable the efficiency operation,

Set a threshold value, the control will work when efficiency is below threshold value, Set up a run and proof timer for stable operation, and Set up a percentage of flow and head variation, the system head and flow must be within that range for a given time before making a pump stage/de-stage decision.

3. Machine Learning and Power Profiling

Since a pump's wire-to-water efficiency is lower than its published hydraulic efficiency, according to the present invention one should consider the pump's wire-to-water efficiency for optimal efficiency operation and energy saving.

The pump's wire-to-water efficiency is typically lower because of losses in the motor and VFD, e.g., including the fact that losses for all pumping systems can be different, losses can vary even for the same pumps because of the selection of motor and VFD, etc. Also the losses in the pumping system typically increase over time because of wear and tear of pumping system. According to the present invention, the control technology/system keeps logging the power points for different flow ranges while the pumping system is running and generates a power profile. The pumping system's power profile is unique to the pumping system and remains updated over the period of operation. This helps to make the decision for an optimal efficiency operation.

Figure 5:
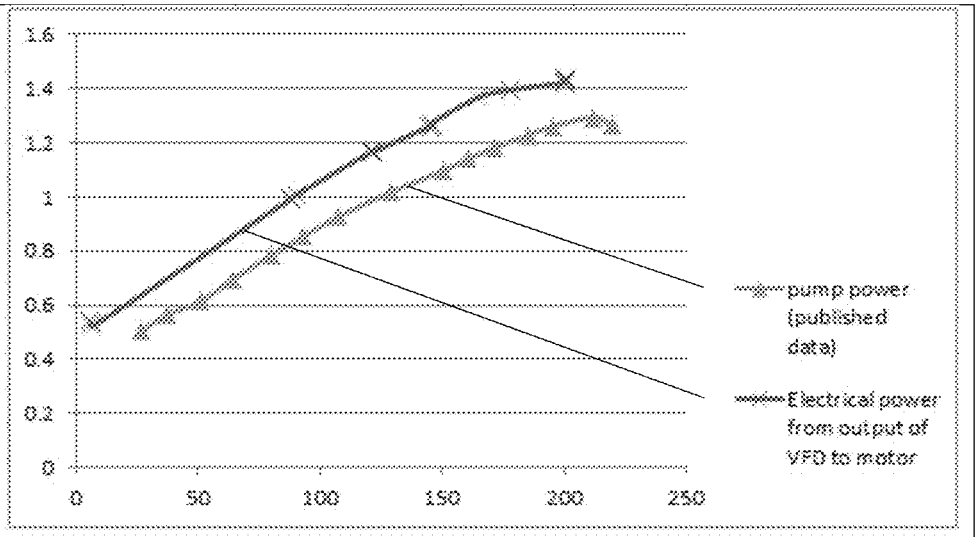
FIG. 5 is a graph of curves of Flow (GPM) vs. Power (HP), for comparing pump power (published data) and electrical power from the output of a Variable Frequency Drive (VFD) to the motor, according to some embodiments of the present invention.
Figure 6:
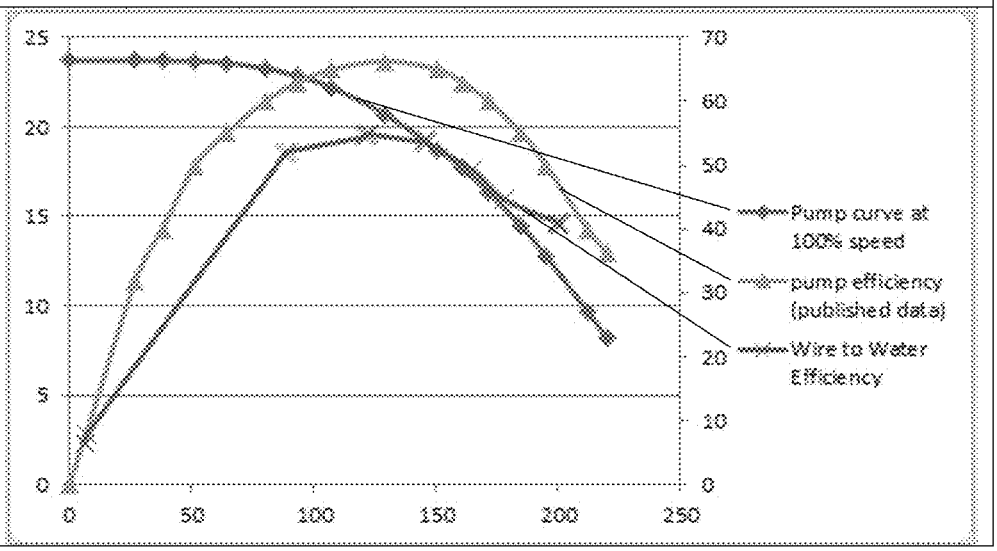
FIG. 6 is a graph of curves of Flow (GPM) vs. Head (ft), and Flow (GPM) vs. Efficiency (%), including a pump curve at 100% speed, a pump efficiency curve (published data) and a wire to wire efficiency curve for comparing pump efficiency (published data) and wire-to-water efficiency, according to some embodiments of the present invention.

See FIGS. 5-6, which respectively show a graph of curves of Flow (GPM) vs. Power (HP), for comparing pump power (published data) and electrical power from the output of a Variable Frequency Drive (VFD) to the motor; and a graph of curves of Flow (GPM) vs. Head (ft), and of Flow (GPM) vs. Efficiency (%), including the pump curve at 100% speed, the pump efficiency curve (published data) and the wire to wire efficiency curve for comparing pump efficiency (published data) and wire-to-water efficiency.

Calculation

By way of example, and according to some embodiments of the present invention, one can calculate/predict a new efficiency using the power profile if running N−1 pumps and N+1 pumps in the pumping system to achieve the same H head and Q flow that the pumping system is achieving with N number of pump running.

Pump flow-pressure curve and flow-power curve can be represented in a second order polynomial equation, $Y=AX^2+BX+C$, where A, B and C are coefficient of equation.

The relation between the pump power and flow using the second order polynomial equation can be expressed as:

$$\frac{H}{W^2} = A1*\left(\frac{Q}{W}\right)^2 + B1*\left(\frac{Q}{W}\right) + C1 \quad \text{(Eq. 1)}$$

The relation between the pump power and flow using the second order polynomial equation can be expressed as:

$$\frac{P}{W^3} = A2*\left(\frac{Q}{W}\right)^2 + B2*\left(\frac{Q}{W}\right) + C2, \quad \text{(Eq. 2)}$$

where W is the speed ratio:

$$W = \frac{Sc}{S},$$

S=Pump maximum speed,
$S_c$=Pump current speed,
H=Current system differential pressure,
Q=Current system total flow,
P=System power consumption,
A1, B1 and C1 are coefficient of the head-flow second order polynomial equation on maximum speed, it can be derived from polynomial equation regression.
A2, B2 and C2 are coefficient of power-flow second order polynomial equation on maximum speed, it can be derived from polynomial equation regression.

Step-1:

In step 1, calculate the current system efficiency with N number of pump(s) running in system:

$$\eta \text{ current} = \frac{Q*H}{P}*C,$$

Where:
$\eta_{current}$=Current system efficiency, and
C=constant.

Step-2:

In step 2, calculate/predict the speed ratio $W_{calculated}$ if run $N_p$=N+1 pump in the pumping system to achieve the same H head and Q flow that system is achieving with N pump(s) running. Solve the equation-1 for $W_{calculated}$ speed ratio.

$$W_{calculated} = \frac{-B1*\frac{Q}{Np} + \sqrt{\left(B1*\frac{Q}{Np}\right)^2 - 4*C1*\left(A1*\left(\frac{Q}{Np}\right)^2 - H\right)}}{2*C1}$$

Step-3:

In step 3, calculate/predict the power $P_{calculated}$ if running $N_p$ at $W_{calculated}$ speed ratio, use equation-2 to calculate power $$P_{calculated} = \left(A2*\left(\frac{Q}{W*Np}\right)^2 + B2*\left(\frac{Q}{W*Np}\right) + C2\right)*W^3*Np$$

Step-4:

In step 4, calculate/predict the new system efficiency with Np number of pumps running in the pumping system, as follows:

$$\eta \text{ calculated} = \frac{Q*H}{Pcalculated}*C,$$

Where
$\eta_{calculated}$=Calculated system efficiency, and
C=constant.

Step-5:

In step 5, repeat the step 1 to step 4 for N−1 and N+1 pump and compare the $\eta_{calculated}$ and $\eta_{current}$.

If the calculated/predicted efficiency is higher than the current efficiency $\eta_{calculated}>\eta_{current}$, then change the number of pumps running.

FIG. 7

Figure 7:
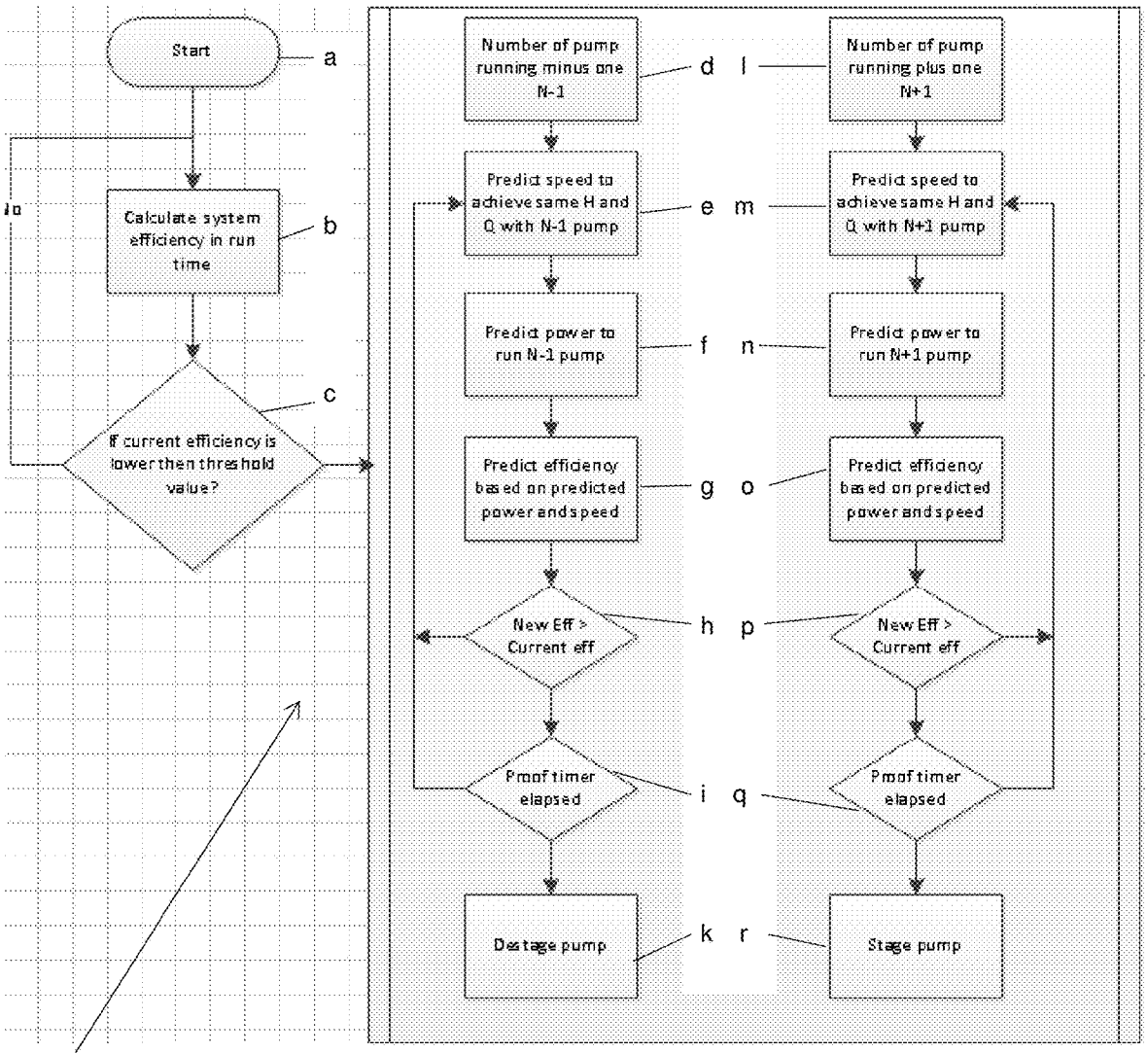
FIG. 7 is a flowchart having steps for determining at least one calculation/prediction of at least one efficiency of at least one combination/number of N−1 and/or N+1 parallel pumps to achieve a corresponding/same head H and flow F by implementing a machine learning algorithm, according to some embodiments of the present invention.

See FIG. 7 showing a flowchart generally indicated as 50 having steps a through r for the pump staging/destaging decision making process using the efficiency method, according to some embodiments of the present invention, e.g., where steps a through c calculate the system efficiency in run time for the pumping system having N pumps, e.g., consistent with that set forth in steps 1-4 above, where steps d through k calculate the system efficiency in run time for the pumping system having N−1 pumps and possible destaging of a pump in step k, e.g., consistent with that set forth in step 5 above, and where steps l through r calculate the system efficiency in run time for the pumping system having N+1 pumps and possible staging of a pump in step k, e.g., consistent with that set forth in step 5 above.

The flowchart 50 shown in FIG. 7 may include, or may form part of, the machine learning algorithm having associated steps used to implement the present invention according to some embodiments.

Steps a-c

In particular, in steps b and c, the signal processor 10*a* is configured to calculate the system efficiency in run time, and if the current efficiency is lower than the threshold efficiency, then the signal processor 10*a* is configured to implement steps d through i to determine if a pump needs to be destaged in step k, and to implement steps i through q to determine if a pump needs to be staged in step r. The threshold efficiency is understood to be an efficiency that is a pumping system parameter determined and provided by the operator of the pumping system that will depend on the particular pumping system, the application of the pumping system, etc. By way of example, the threshold efficiency may be determined by the operator to be 60%, 75%, 90%, etc. However, the scope of the invention is not intended to be limited to any particular threshold efficiency.

Steps d-k: Destaging

In step e, the signal processor 10*a* is configured to predict the speed to achieve the same head H and flow Q with N−1 pumps.

In step f, the signal processor 10*a* is configured to predict the power to run N−1 pumps.

In step g, the signal processor 10*a* is configured to predict the efficiency based upon the predicted power and speed.

In step h, the signal processor 10*a* is configured to determine if the new efficiency is greater than the current efficiency, and destage a pump if needed in step k.

In step i, the signal processor 10*a* is configured to determine if the proof time has elapsed, and if so, then go to step e.

Steps l-r: Staging

In step m, the signal processor 10*a* is configured to predict the speed to achieve the same head H and flow Q with N+1 pumps.

In step n, the signal processor 10*a* is configured to predict the power to run N+1 pumps.

In step o, the signal processor 10*a* is configured to predict the efficiency based upon the predicted power and speed.

In step p, the signal processor 10*a* is configured to determine if the new efficiency is greater than the current efficiency, and stage a pump if needed in step r.

In step q, the signal processor 10*a* is configured to determine if the proof time has elapsed, and if so, then go to step m.

The Controller

By way of example, the functionality of the controller may be implemented using hardware, software, firmware, or a combination thereof. In a typical software implementation, the controller would include one or more microprocessor-based architectures having, e. g., at least one signal processor or microprocessor like element 10*a*. A person skilled in the art would be able to program such a microcontroller (or microprocessor)-based implementation to perform the functionality described herein without undue experimentation. The scope of the invention is not intended to be limited to any particular implementation using technology either now known or later developed in the future. The scope of the invention is intended to include implementing the functionality of the processors 10*a* as stand-alone processor or processor module, as separate processor or processor modules, as well as some combination thereof.

The apparatus 10 and/or controller may also include other signal processor circuits or components 10*b*, e.g. including random access memory (RAM) and/or read only memory (ROM), input/output devices and control, and data and address buses connecting the same, and/or at least one input processor and at least one output processor.

The Scope of the Invention

The embodiments shown and described in detail herein are provided by way of example only; and the scope of the invention is not intended to be limited to the particular configurations, dimensionalities, and/or design details of these parts or elements included herein. In other words, one skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein and thereto without departing from the spirit and scope of the present invention.

What we claim is:

1. An apparatus comprising:

a controller having a signal processor configured to:

receive signaling containing information about a power profile that is specific to a pumping system having N parallel pumps and based upon data related to pumping system power and wire-to-water efficiency in real time for the N parallel pumps configured to run in the pumping system to generate a head H and a flow F with an efficiency E, and at least one prediction of at least one corresponding efficiency of at least one combination of N−1 or N+1 parallel pumps to achieve a corresponding head H and flow F; and determine a predicted efficiency based on predicted power and speed to run the at least one combination of N−1 or N+1 parallel pumps, and provide corresponding signaling containing information to control the pumping system that depends on a comparison of the efficiency E and the predicted efficiency determined, based upon the signaling received.

2. The apparatus according to claim 1, wherein the signal processor is configured to provide staging or destaging one of the N parallel pumps to or from the pumping system.

3. Apparatus according to claim 1, wherein the signal processor is configured to:

predict corresponding efficiencies to achieve the corresponding head H and flow F for the N−1 and N+1 parallel pumps; and determine the corresponding signaling by selecting a highest efficiency between the efficiency E for the N parallel pumps and the corresponding efficiencies for the N−1 and N+1 parallel pumps.

4. The apparatus according to claim 1, wherein the signal processor is configured to stop or start one of the N parallel pumps from running in the pumping system when changing from the N parallel pumps to the N−1 or N+1 parallel pumps running in the pumping system.

5. The apparatus according to claim 1, wherein the signal processor is configured to implement a machine learning algorithm to update the power profile to determine the at least one combination of the N−1 or N+1 N-parallel pumps required to operate the pumping system in relation to an optimal point on an efficiency curve.

6. The apparatus according to claim 5, wherein the controller comprises an internal database configured to store an updated power profile, including the data related to the pumping system power and wire-to-water efficiency.

7. The apparatus according to claim 1, wherein the apparatus comprises the pumping system having the N parallel pumps.

8. A method comprising:

receiving, with a controller having a signal processor, signaling containing information about a power profile that is specific to a pumping system having N parallel pumps and based upon data related to one or more of pumping system power and wire-to-water efficiency in real time for the N parallel pumps configured to run in the pumping system to generate a head H and a flow F with an efficiency E, and at least one prediction of at least one corresponding efficiency of at least one combination of N−1 or N+1 parallel pumps to achieve a corresponding head H and flow F; and determining, with the controller having the signal processor, a predicted efficiency based on predicted power and speed to run the at least one combination of N−1 or N+1 parallel pumps, and provide corresponding signaling containing information to control the pumping system that depends on a comparison of the efficiency E and the predicted efficiency determined, based upon the signaling received.

9. The method according to claim 8, wherein the method comprises staging or destaging one of the N parallel pumps to or from the pumping system.

10. The method according to claim 8, wherein the method comprises:

predicting with the signal processor corresponding efficiencies for the N−1 and N+1 parallel pumps to achieve the corresponding head H and flow F; and determining with the signal processor the corresponding signaling by selecting a highest efficiency between the efficiency E for the N parallel pumps and the corresponding efficiencies for the N−1 and N+1 parallel pumps.

11. The method according to claim 8, wherein the method comprises: stopping or starting with the signal processor one of the N parallel pumps from running in the pumping system when changing from the N parallel pumps to the N−1 or N+1 parallel pumps running in the pumping system.

12. The method according to claim 8, wherein the method comprises: implementing with the signal processor a machine learning algorithm to update the power profile to determine the at least one combination of the N−1 or N+1 parallel pumps required to operate the pumping system in relation to an optimal point on an efficiency curve.

13. The method according to claim 12, wherein the method comprises: configuring an internal database to store an updated power profile, including the data related to the pumping system power and wire-to-water efficiency.

14. A method of operating a pump system comprising:

calculating a current system efficiency in run time for a pump system having N pumps with a head H and a flow Q;

determining if the system efficiency calculated is lower than a threshold efficiency, then implementing for N−1 pumps the following:

predicting a speed to achieve the head H and the flow Q with N−1 pumps;

predicting a power to run the N−1 pumps;

predicting a new efficiency based upon the power predicted and the speed predicted;

determining if the new efficiency is greater than the current system efficiency, and destaging a pump in an N pump system if greater; or if the current system efficiency calculated is lower than the threshold efficiency, then implementing for N+1 pumps the following:

predicting a corresponding speed to achieve the head H and the flow Q with N+1 pumps;

predicting a corresponding power to run the N+1 pumps;

predicting a new corresponding efficiency based upon the corresponding power predicted and the corresponding speed predicted;

determining if the new corresponding efficiency is greater than the current system efficiency, and staging an additional pump in the N pump system if greater.

* * * * *